US010397706B2

(12) United States Patent
Reining

(10) Patent No.: US 10,397,706 B2
(45) Date of Patent: Aug. 27, 2019

(54) METHOD FOR AVOIDING AN OFFSET OF A MEMBRANE OF A ELECTRODYNAMIC ACOUSTIC TRANSDUCER

(71) Applicant: Sound Solutions International Co., Ltd., Beijing (CN)

(72) Inventor: Friedrich Reining, Vienna (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 15/936,909

(22) Filed: Mar. 27, 2018

(65) Prior Publication Data

US 2018/0279051 A1 Sep. 27, 2018

(30) Foreign Application Priority Data

Mar. 27, 2017 (AT) ..... 50243/2017

(51) Int. Cl.
*H04R 1/00* (2006.01)
*H04R 25/00* (2006.01)
(Continued)

(52) U.S. Cl.
CPC ..... *H04R 9/063* (2013.01); *H04R 9/08* (2013.01); *H04R 29/003* (2013.01); *H04R 3/04* (2013.01); *H04R 2209/041* (2013.01)

(58) Field of Classification Search
CPC ..... H04R 29/003; H04R 3/04; H04R 9/063
(Continued)

(56) References Cited

U.S. PATENT DOCUMENTS 5,493,620 A 2/1996 Pulfrey
2005/0031117 A1* 2/2005 Browning ..... H04M 1/6016 379/391
(Continued)

FOREIGN PATENT DOCUMENTS

DE 102010010102 A1 9/2011
EP 1799013 A1 6/2007
(Continued)

OTHER PUBLICATIONS

First Office Action issued for priority AT application No. A50243/2017, dated Feb. 16, 2018.
(Continued)

*Primary Examiner* — Khai N. Nguyen
(74) *Attorney, Agent, or Firm* — Steven McMahon Zeller; Dykema Gossett PLLC

(57) ABSTRACT

A method for avoiding an offset of a membrane (3) of an electrodynamic acoustic transducer (1) having two voice coils (7, 8) is presented, wherein a control voltage ($U_{CTRL}$) is applied to at least one of the voice coils (7, 8) until the electromotive force ($U_{emf1}$) of the first coil (7) or a parameter derived thereof and the electromotive force ($U_{emf2}$) of the second coil (8) or a parameter derived thereof substantially reach a predetermined relation. Furthermore, an electronic offset compensation circuit (12) is presented, which performs the above application of a control voltage ($U_{CTRL}$). Finally, the invention relates to a transducer system with a transducer (1) and an electronic offset compensation circuit (12) connected to the transducer (1).

21 Claims, 2 Drawing Sheets

(51) Int. Cl.

| | |
|---|---|
| ***H04R 9/06*** | (2006.01) |
| ***H04R 11/02*** | (2006.01) |
| ***H04R 29/00*** | (2006.01) |
| ***H04R 9/08*** | (2006.01) |
| *H04R 3/04* | (2006.01) |

(58) Field of Classification Search
USPC ..... 381/396, 401, 402
See application file for complete search history.

(56) References Cited

U.S. PATENT DOCUMENTS

2005/0031139 A1 2/2005 Browning et al.
2006/0104451 A1* 5/2006 Browning ..... H04R 29/003 381/59
2008/0025551 A1* 1/2008 Wehner ..... H04R 9/04 381/401
2009/0028371 A1 1/2009 Bailey
2009/0295163 A1* 12/2009 Frayne ..... F03B 17/06 290/54
2011/0160883 A1 6/2011 Yasuda et al.
2012/0215055 A1* 8/2012 Van Vlem ..... H04R 25/405 600/25
2014/0321690 A1* 10/2014 Reining ..... H04R 9/02 381/396
2016/0127833 A1 5/2016 Yasuda et al.
2018/0279051 A1* 9/2018 Reining ..... H04R 9/063
2018/0279052 A1* 9/2018 Reining ..... H04R 9/063

FOREIGN PATENT DOCUMENTS

EP 2663092 A2 11/2013
WO 2005015955 A2 2/2005

OTHER PUBLICATIONS

First Office Action dated Dec. 18, 2019 for counterpart German patent application No. 102018002289.8.

* cited by examiner

METHOD FOR AVOIDING AN OFFSET OF A MEMBRANE OF A ELECTRODYNAMIC ACOUSTIC TRANSDUCER

CROSS-REFERENCE TO RELATED APPLICATIONS

This application claims priority to Austria Patent Application No. A50243/2017, filed on Mar. 27, 2017, which is hereby incorporated by reference in its entirety.

BACKGROUND OF THE INVENTION

The invention relates to a method for avoiding an offset of a membrane of an electrodynamic acoustic transducer having two voice coils. Moreover, the invention relates to an electronic offset compensation circuit, which is designed to be connected to a coil arrangement of an electrodynamic acoustic transducer. The electrodynamic acoustic transducer comprises a membrane, a coil arrangement attached to the membrane and a magnet system being designed to generate a magnetic field transverse to a longitudinal direction of a wound wire of the coil arrangement. The coil arrangement of said transducer comprises two voice coils. Finally, the invention relates to a transducer system, comprising an electrodynamic acoustic transducer and an electronic offset compensation circuit of the kind above, wherein the electronic offset compensation circuit is electrically connected to the coil arrangement.

A method, an electronic circuit and a transducer system of the kind above generally is known in prior art. In this context, US 2014/321690 A1 discloses an audio system that comprises an electro-acoustic transducer connected to a first driver circuit and a second driver circuit. The electro-acoustic transducer comprises a first coil stacked on a second coil mechanically linked to a membrane, with the coils oscillating in the magnetic field of a permanent magnet focused by a pole plate. The first coil and the second coil are mechanically arranged symmetrical to the pole plate in a rest position.

While in US 2014/321690 A1 the first and the second coil are considered to rest in a magnetic zero position, reality shows that this condition cannot be fulfilled under all circumstances. Generally, such a deviation may be caused by a specific design and/or tolerances during manufacturing. As a consequence, the audio output of the transducer can be distorted, particularly at high power levels, and/or algorithms for calculating a membrane position can output wrong values.

SUMMARY OF THE INVENTION

Thus, it is an object of the invention to overcome the drawbacks of the prior art and to provide an improved offset compensation method, an improved electronic offset compensation circuit and an improved transducer system. Particularly, an offset of a membrane from a desired position shall be avoided.

The inventive problem is solved by a method as defined in the opening paragraph, wherein a control voltage is applied to at least one of the voice coils and altered until the electromotive force $U_{emf1}$ of the first coil or a parameter derived thereof and the electromotive force $U_{emf2}$ of the second coil or said parameter derived thereof substantially reach a predetermined relation. In other words, a control voltage is applied to at least one of the voice coils and altered until the instantaneous relation between the electromotive force $U_{emf1}$ of the first coil and the electromotive force $U_{emf2}$ of the second coil substantially equals a desired relation or until the instantaneous relation between a parameter derived from the electromotive force $U_{emf1}$ of the first coil and the parameter derived from the electromotive force $U_{emf2}$ of the second coil substantially equals a desired relation. The electrodynamic acoustic transducer has a coil arrangement with two voice coils, which coil arrangement is attached to the membrane, and has a magnet system being designed to generate a magnetic field transverse to a longitudinal direction of a wound wire of the coil arrangement.

Additionally, the inventive problem is solved by an electronic offset compensation circuit as defined in the opening paragraph, wherein the electronic offset compensation circuit is designed to apply a control voltage to at least one of the voice coils and to alter said control voltage until the electromotive force $U_{emf1}$ of the first coil or a parameter derived thereof and the electromotive force $U_{emf2}$ of the second coil or said parameter derived thereof substantially reach a predetermined relation.

Finally, the inventive problem is solved by a transducer system, comprising an electrodynamic acoustic transducer and an electronic offset compensation circuit of the kind above, wherein the electronic offset compensation circuit is electrically connected to the transducer's coil arrangement.

In real applications, the first and the second coil often do not rest in a magnetic zero position. In other words, the idle position of the membrane (x=0) often does not coincide with the point where the electromotive force $U_{emf1}$ of the first coil equals the electromotive force $U_{emf2}$ of the second coil. This may be caused intentionally by design or unintentionally by tolerances.

By the disclosed measures, the coil arrangement is shifted to a desired idle position, which is characterized by the relation between the electromotive force $U_{emf1}$ of the first coil/a parameter derived thereof and the electromotive force $U_{emf2}$ of the second coil/said parameter derived thereof. This relation can be a particular ratio or a difference between said values. "Substantially" in the given context particularly means a deviation of ±10% from a reference value. However, it should be noted that the aim of the control method generally is a zero deviation from the reference value.

The desired idle position especially can be the magnetic zero position, in which the idle position of the membrane (x=0) coincides with the point where the electromotive force $U_{emf1}$ of the first coil equals the electromotive force $U_{emf2}$ of the second coil (i.e. a ratio between said values is substantially 1, respectively a difference between said values is substantially 0 then). In other words, the conjunction area between the voice coil in this case is held in a position, in which the magnetic field of the magnet system reaches a maximum.

By use of the proposed method/the proposed electronic offset compensation circuit, the membrane may be shifted into that position, which is intended as the idle position by design thereby compensating tolerances and improving the performance of the transducer in general. For example, distortions of the audio output of the transducer can be reduced in this way. Furthermore, symmetry may be improved thereby allowing for the same membrane stroke in forward and backward direction. In yet another application algorithms for calculating a membrane position are improved by the proposed measures.

Generally, the control voltage should not interfere with sound output by the transducer, but should just compensate an offset position of the membrane in a more or less fast way. Accordingly, the control voltage beneficially is slow in comparison to the sound. In other words, a frequency of an alternating component of the control voltage beneficially is low in comparison to the frequencies of the sound. In case of micro speakers, a frequency of an alternating component of the control voltage may be 50 Hz. For other speakers this frequency may be 10 Hz. In view of a fast changing sound signal, the control voltage may be seen as a DC-voltage. In special cases, the control voltage indeed may be a DC-voltage. Alternatively, the control voltage may comprise an alternating component and a constant component.

The disclosed measures are of particular advantage in the context of methods or systems for calculating a position of the transducer's membrane. For example, a method for calculating the excursion x of membrane of an electrodynamic acoustic transducer, in particular of a loudspeaker, comprises the steps of a) calculating a velocity v of the membrane based on an input voltage $U_{in}$ and an input current $I_{in}$ to a coil of the transducer and based on an idle driving force factor BL(0) of the transducer in an idle position of the membrane;

b) calculating a position x of the membrane by integrating said velocity v;

c) calculating the velocity v of the membrane based on the input voltage $U_{in}$ and the input current $I_{in}$ to the coil of the transducer and based on a driving force factor BL(x) of the transducer at the position x of the membrane calculated in step b) and d) recursively repeating steps b) and c).

In this context, also an electronic offset compensation circuit is presented, which is designed to be connected to the coil arrangement of the electrodynamic acoustic transducer and which is designed to a) calculate a velocity v of the membrane based on an input voltage $U_{in}$ and an input current $I_{in}$ to a coil of the transducer and based on an idle driving force factor BL(0) of the transducer in an idle position of the membrane;

b) calculate a position x of the membrane by integrating said velocity v;

c) calculate the velocity v of the membrane based on the input voltage $U_{in}$ and the input current $I_{in}$ to the coil of the transducer and based on a driving force factor BL(x) of the transducer at the position x of the membrane calculated in step b) and to d) recursively repeat steps b) and c).

In the above context, the electronic offset compensation circuit position comprises the functions of a position calculation module and a offset compensation module. Accordingly, the electronic offset compensation circuit may also be termed "electronic offset compensation and position calculation circuit" in the above context.

Furthermore, the electronic offset compensation circuit being electrically connected to the coil arrangement may be part of the transducer system. Particularly, an electronic offset compensation module and the electronic position calculation module may be part of the same electronic circuit. Moreover, an amplifier driving the electrodynamic acoustic transducer may be part of the electronic offset compensation circuit, too.

By the measures presented above, the position x of the membrane can be determined without the need of additional means in the transducer. Instead, just the coil is needed, which is part of an electrodynamic acoustic transducer anyway. By application of the control voltage as disclosed above, the integration of the membrane velocity starts at the intended zero position of the membrane. That is why the membrane position x can be calculated with high accuracy. Having the position of the membrane, non-linearity of the driving force factor BL(x) can be compensated thus even more reducing distortions of the sound output by the electrodynamic acoustic transducer. In other words, sonic waves emanating from the transducer nearly perfectly fit to the electric sound signal being applied to the transducer. Alternatively, or in addition, the level of the electric sound signal may be limited, or it may be cut off at high membrane excursions x so as to avoid damages of transducer.

The proposed electronic offset compensation method and circuit particularly apply to micro speakers, whose membrane area is smaller than 300 $mm^2$. Such micro speakers are used in all kind of mobile devices such as mobile phones, mobile music devices and/or in headphones.

It should be noted that the position calculation method and the position calculation module as well as a transducer system comprising such a position calculation module can form the basis of an independent invention without the limitations of claims 1 and 18.

Further details and advantages of the audio transducer of the disclosed kind will become apparent in the following description and the accompanying drawings.

Beneficially, the electromotive force Uemf1 of the first coil and the electromotive force $U_{emf2}$ of the second coil can be calculated by the formulas $$U_{emf1}=U_{in1}(t)-Z_{C1}\cdot I_{in}(t)$$

$$U_{emf2}=U_{in2}(t)-Z_{C2}\cdot I_{in}(t)$$

wherein $Z_{C1}$ is the (instantaneous) coil resistance of the first coil, $U_{in1}(t)$ is the input voltage to the first coil at the time t and $I_{in}(t)$ is the input current to the first coil at the time t. Accordingly, $Z_{C2}$ is the (instantaneous) coil resistance of the second coil, $U_{in2}(t)$ is the input voltage to the second coil at the time t and $I_{in}(t)$ is the input current to the second coil at the time t. It should be noted that the first and the second coil are switched in series so that the current $I_{in}(t)$ is the same for both coils.

Furthermore, it should be noted that $Z_{C1}$ and $Z_{C2}$ are complex numbers in the above formulas. However, for a simplified calculation also the (real valued and instantaneous) coil resistances of the first coil and the second coil $R_{C1}$ and $R_{C2}$ may be used instead of the complex values $Z_{C1}$ and $Z_{C2}$, thus neglecting capacitive/inductive components of the coil resistance. Accordingly, "$Z_{C1}$" may be changed to "$R_{C1}$", "$Z_{C2}$" may be changed to "$R_{C2}$" and "$Z_C$" may be changed to "$R_C$" in this disclosure. For the formulas for the electromotive force $U_{emf1}$ of the first coil and the electromotive force $U_{emf2}$ of the second coil for example this means $$U_{emf1}=U_{in1}(t)-R_{C1}\cdot I_{in}(t)$$

$$U_{emf2}=U_{in2}(t)-R_{C2}\cdot I_{in}(t)$$

It should also be noted that the coil resistance $Z_C$ is not necessarily constant over time, but may change in accordance with a coil temperature for example. For measuring the coil resistance $Z_C$ an (inaudible) tone or sine signal may be applied to the transducer. In case of a micro speaker such a tone or sine signal particularly may have a frequency below 100 Hz, for example 50 Hz. It should be noted that the coil resistance $Z_C$ slowly varies over time. That is why the coil resistance $Z_C$ is considered as to be constant in view of the fast variation of the input voltages $U_{in1}(t)$ and $U_{in2}(t)$ and in view of the input current to the second coil at the time t. However, strictly speaking the coil resistance may also be denoted with "$Z_C(t)$".

Beneficially, a parameter derived from the electromotive force $U_{emf1}$, $U_{emf2}$ is an absolute value of the electromotive force $U_{emf1}$, $U_{emf2}$, a square value of the electromotive force $U_{emf1}$, $U_{emf2}$ or a root mean square value of the electromotive force $U_{emf1}$, $U_{emf2}$. Accordingly, a control voltage may be applied to at least one of the voice coils and altered until

- an absolute value of the electromotive force $U_{emf1}$ of the first coil and an absolute value of the electromotive force $U_{emf2}$ of the second coil or
- a square value of the electromotive force $U_{emf1}$ of the first coil and a square value of the electromotive force $U_{emf2}$ of the second coil or
- a root mean square value of the electromotive force $U_{emf1}$ of the first coil and a root mean square value of the electromotive force $U_{emf2}$ of the second coil substantially reach a predetermined relation. In this way, the offset compensation method is based on a relation of the energy in the coils respectively based on a relation of a parameter derived from the energy in the coils due to the electromotive force. Especially if the predetermined relation is a predetermined ratio, mathematical operations may be applied to both the numerator and the denominator without changing the ratio.

In a very advantageous embodiment, a control voltage is applied to at least one of the voice coils and altered until the low pass filtered electromotive force $U_{emf1}$ of the first coil/a parameter derived thereof and the low pass filtered electromotive force $U_{emf2}$ of the second coil/said parameter derived thereof substantially reach a predetermined relation. In other words, the control voltage is applied to at least one of the voice coils and altered until the electromotive force $U_{emf1}$ of the first coil filtered by a first filter/a parameter derived thereof and the electromotive force $U_{emf2}$ of the second coil filtered by said first filter/said parameter derived thereof substantially reach a predetermined relation. Or a control voltage is applied to at least one of the voice coils and altered until the electromotive force $U_{emf1}$ of the first coil/a parameter derived thereof and the electromotive force $U_{emf2}$ of the second coil/said parameter derived thereof substantially reach a predetermined relation below a particular frequency. Concretely, the electromotive forces $U_{emf1}$ and $U_{emf2}$/parameters derived thereof can be determined in the whole audio band in a first step, the energy of the electromotive forces $U_{emf1}$ and $U_{emf2}$ respectively a parameter thereof can be determined in a second step, and the result of the second step can be low pass filtered by a filter in a third step before the signals obtained in the third step are used for application of the control voltage. In normal use, signals comprising a bunch of frequencies are fed into a transducer, e.g. ranging from 100 Hz to 20 kHz in case of a micro speaker and from 20 Hz to 20 kHz in case of other speakers. Without limiting the disclosed offset compensation method to low frequencies, e.g. by use of a low pass filter, application of the control voltage can foil the conversion of the applied signal. The border frequency of such a first filter may be 50 Hz in case of a micro speaker and 10 Hz case of other speakers. Further preferred values are 20 Hz in case of a micro speaker and 5 Hz case of other speakers.

Advantageously, a delta sigma modulation is used for applying a control voltage to at least one of the voice coils. In this case, a deviation from the target relation between the electromotive force $U_{emf1}$ of the first coil/a parameter derived thereof and the electromotive force $U_{emf2}$ of the second coil/said parameter derived thereof is summed with opposite sign and applied to the coil arrangement thus compensating the above deviation. A delta sigma modulator can also be considered as an integral controller, and other integration controllers may be used for the application of a control voltage to at least one of the voice coils as well.

In a preferred embodiment, the signal output by the delta sigma modulator is fed into a second filter before it is applied to the coil arrangement, thus reducing or avoiding instability in the control loop. As a result, the membrane is slowly modulated in order to swing around the desired position. The speed of this movement is defined by the lower limit frequency of said second filter. In general, the disclosed control loop can be realized by low order systems, but performance may be enhanced by use of higher order control systems, for example PID-control systems (proportional-integral-derivative control systems).

Generally, the control voltage can be applied to one of the voice coils of the coil arrangement. However, in a beneficial embodiment, the control voltage is applied to both the first coil and the second coil. In this way, the control voltage for shifting the coil arrangement to the magnetic zero position may be comparably low.

Beneficially, a sound signal is applied to both the first coil and the second coil during application of a control voltage. In this way, the offset compensation method and the membrane position calculation method can be executed during normal use of the electrodynamic acoustic transducer and not just under laboratory conditions. It is equally imaginable to output sound to one of the coils and the control voltage to the other coil. Also in this case, a sound signal and the control signal are superimposed.

Furthermore, it is advantageous if the sound signal is applied just to an outer tap of the serially connected voice coils, in particular by a single amplifier. Accordingly, just an outer tap of the coil arrangement/serially connected voice coils is electrically connected to an audio output of an amplifier. In other words, a current caused by the sound signal flows into a first outer tap of the coil arrangement, sequentially through each of the coils and out of a second outer tap of the coil arrangement.

By these measures, the technical complexity of a transducer system and costs for producing the same are reduced. At the same time reliability is increased. Concretely, wiring of the electrodynamic acoustic transducer is eased. Particularly, the electrical connection to outer taps of the coil arrangement are the only electrical connection between the amplifier and the coil arrangement.

By eliminating the need of a separate amplifier for each voice coil of the coil arrangement, reliability can substantially be increased. For coil arrangements having two voice coils, the risk for a failure of the amplification part of the transducer system is reduced by 50%.

It should be noted that the application of a sound signal just to an outer tap of the serially connected voice coils as well as a transducer system with those features can form the basis of an independent invention without the limitations of claims 1 and 18.

The amplifier may be an unipolar amplifier having one sound output and a connection to ground. In this case one outer tap of the coil arrangement/serially connected voice coils is electrically connected to the audio output of the amplifier, the other one is connected to ground. However, the amplifier may also be a bipolar one having two dedicated sound outputs. In this case one outer tap of the coil arrangement/serially connected voice coils is electrically connected to a first audio output of the amplifier, the other one is connected to the other second audio output. Generally, an amplifier may have more amplification stages. In this case, the outputs of the intermediate stages are not considered to have an "audio output" for the concerns of this disclosure. The "audio output" is the output of the very last stage, which finally is connected to the transducer.

Beneficially, a connection point between two voice coils is electrically connected to an input of the offset compensation circuit. In this way, the voltage at the connection point may be used for controlling the transducer system. In particular, an offset of the coil arrangement from a zero position may be detected and corrected.

Particularly, the electrical connection to outer taps of the coil arrangement and the electrical connection to the connection point between two voice coils are the only electrical connections between the amplifier and the coil arrangement in the above case. The connection point between two voice coils moreover may be connected just to an input of the offset compensation circuit. In this way, wiring between the amplifier and the electrodynamic transducer is comparably easy in view of the function of the transducer system.

In yet another beneficial embodiment, the velocity v, the input voltage $U_{in}$, the input current $I_{in}$, the idle driving force factor BL(0), the driving force factor BL(x) and the position x are related to the same point in time t. In this way, the position x of the membrane at a particular point in time may iteratively be calculated by recursively repeat steps b) and c) until a desired accuracy is obtained. For example, a deviation of positions x calculated in subsequent iterations respectively in subsequent steps c) can be determined for determination of the obtained accuracy.

In another beneficial variant of the presented method, the velocity v, the input voltage $U_{in}$, the input current $I_{in}$, the idle driving force factor BL(0), the driving force factor BL(x) and the position x are related to different points in time t. In this way, the determination of the position x of the moving membrane is an ongoing process. Particularly, the method comprises the steps of a) calculating a velocity v(t) of the membrane based on an input voltage $U_{in}(t)$ and an input current $I_{in}(t)$ to a coil of the transducer and based on an idle driving force factor BL(0) of the transducer in an idle position of the membrane;

b) calculating a position x(t) of the membrane by integrating said velocity v(t);

c) calculating the velocity v(t+1) of the membrane based on the input voltage $U_{in}(t+1)$ and the input current $I_{in}(t+1)$ to the coil of the transducer and based on a driving force factor BL(x(t)) of the transducer at the position x(t) of the membrane calculated in step b) and d) recursively repeating steps b) and c) wherein t gets t+1.

The method involves a phase shift and an error of the calculated membrane position x in view of the actual membrane position. However, this phase shift and this error may be kept low if the calculations are fast in relation to the moving speed of the membrane. Generally, the phase shift and the error are the lower the lower the frequency of the membrane is and the higher a clock frequency of a calculating device (e.g. the electronic offset compensation circuit) is.

Beneficially, the position x of the membrane is calculated by the formula $$x(t)=x(t-1)+v(t)\cdot\Delta t$$

which is a numerical representation of $$x(t)=\int v(t)\cdot dt$$

Furthermore, it is advantageous, if the velocity v of the membrane is calculated by the formula $$v(t)=(U_{in}(t)-Z_C\cdot I_{in}(t))/BL(0) \text{ in step } a) \text{ or by}$$

$$v(t+1)=(U_{in}(t+1)-Z_C\cdot I_{in}(t+1))/BL(x(t)) \text{ in step } c)$$

In this way, the calculation is based on the electromotive force $U_{emf}$ of a coil, which can easily be calculated by $$U_{emf}=U_{in}(t)-Z_C\cdot I_{in}(t)$$

wherein $Z_C$ is the coil resistance.

In an alternative variant of the presented method the velocity v of the membrane is calculated by the formula $$v(t+1)=v_(t+1)\cdot BL(0)/BL(x(t)) \text{ in step } c) \text{ wherein}$$

$$v_(t+1)=(U_{in}(t+1)-Z_C\cdot I_{in}(t+1))/BL(0)$$

Here, a rough approximation of the velocity v~ of the membrane is calculated with the idle driving force factor BL(0) in the idle position of the membrane in a first step, which is corrected then by a factor showing the relation between BL(0) and BL(x).

Beneficially, the velocity v of the membrane is calculated by use of the electromotive force $U_{emf1}$ of the first coil or the electromotive force $U_{emf2}$ of the second coil or the sum of the electromotive force $U_{emf1}$ of the first coil and the electromotive force $U_{emf2}$ of the second coil.

Depending on which coil resistance and which driving force factor is known, the velocity v of the membrane can be calculated by use of one or more of the following formulas:

$$v(t)=(U_{in1}(t)-Z_{C1}\cdot I_{in}(t))/BL1$$

$$v(t)=(U_{in2}(t)-Z_{C2}\cdot I_{in}(t))/BL2$$

$$v(t)=(U_{in1}(t)+U_{in2}(t)-(Z_{C1}+Z_{C2})\cdot I_{in}(t))/BL12$$

wherein BL12 is the driving force factor of the whole coil arrangement.

It should be noted at this point that the various embodiments for the method and the advantages related thereto equally apply to the disclosed electronic circuits and the transducer system and vice versa.

BRIEF DESCRIPTION OF THE DRAWINGS

These and other aspects, features, details, utilities, and advantages of the invention will become more fully apparent from the following detailed description, appended claims, and accompanying drawings, wherein the drawings illustrate features in accordance with exemplary embodiments of the invention, and wherein:

Like reference numbers refer to like or equivalent parts in the several views.

DETAILED DESCRIPTION OF EMBODIMENTS

Figure 1:
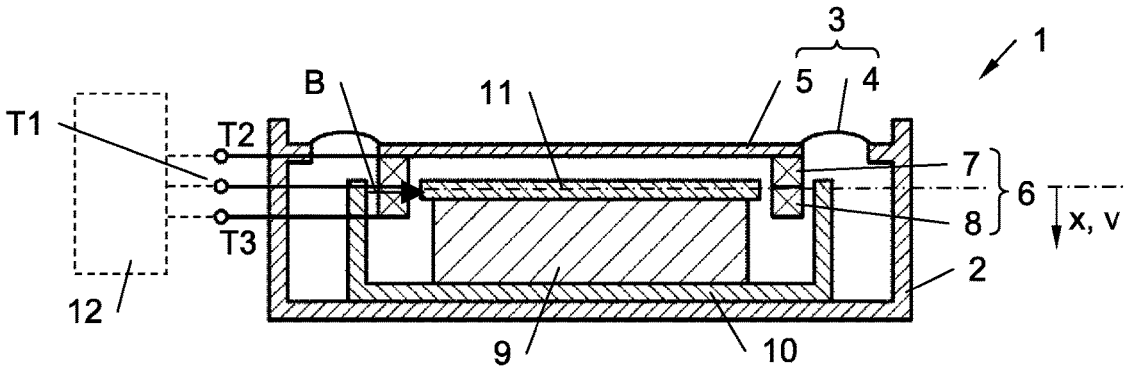
FIG. 1 shows a cross sectional view of an exemplary transducer.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

All directional references (e.g., "plus", "minus", "upper", "lower", "upward", "downward", "left", "right", "leftward", "rightward", "front", "rear", "top", "bottom", "over", "under", "above", "below", "vertical", "horizontal", "clockwise", and "counterclockwise") are only used for identification purposes to aid the reader's understanding of the present disclosure, and do not create limitations, particularly as to the position, orientation, or use of the any aspect of the disclosure. It is to be understood that the terms so used are interchangeable under appropriate circumstances such that the embodiments of the invention described herein are, for example, capable of operation in other orientations than those illustrated or otherwise described herein.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., "attached", "coupled", "connected", and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

All numbers expressing measurements and so forth used in the specification and claims are to be understood as being modified in all instances by the term "about" or "substantially", which particularly means a deviation of ±10% from a reference value.

FIG. 1 shows an example of an electrodynamic acoustic transducer 1, which may be embodied as a loudspeaker, in cross sectional view. The transducer 1 comprises a housing 2 and a membrane 3 having a bending section 4 and a center section 5, which is stiffened by a plate in this example. Furthermore, the transducer 1 comprises a coil arrangement 6 attached to the membrane 3. The coil arrangement 6 comprises a first coil 7 and a second coil 8. The first coil 7 is arranged on top of the second coil 8 and concentric to the second coil 8 in this example. Furthermore, the transducer 1 comprises a magnet system with a magnet 9, a pot plate 10 and a top plate 11. The magnet system generates a magnetic field B transverse to a longitudinal direction of a wound wire of the coil arrangement 6.

Additionally, the electrodynamic acoustic transducer 1 comprises three connection terminals T1 . . . T3 electrically connected to the coils 7, 8 and connected to an electronic offset compensation circuit 12. The electrodynamic acoustic transducer 1 and the electronic offset compensation circuit 12 form a transducer system.

The excursion of the membrane 3 is denoted with "x" in the example shown in FIG. 1, its velocity with "v". As known, a current through the coil arrangement 6 causes a movement of the membrane 3 and thus sound, which emanates from the transducer 1.

Figure 2:
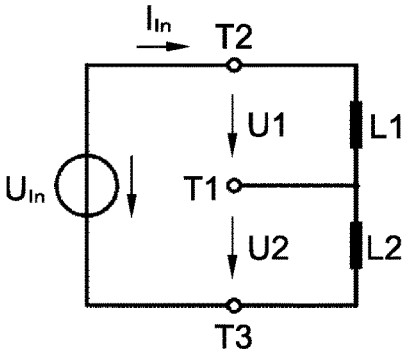
FIG. 2 shows a simplified circuit diagram of the transducer 1 shown in FIG. 1.

FIG. 2 shows a simplified circuit diagram of the transducer 1 shown in FIG. 1. Concretely, FIG. 2 shows a voltage source, generating the voltage $U_{in}$, which is fed to a serial connection of a first inductance L1, which is formed by the first voice coil 7, and a second inductance L2, which is formed by the second voice coil 8.

Figure 3:
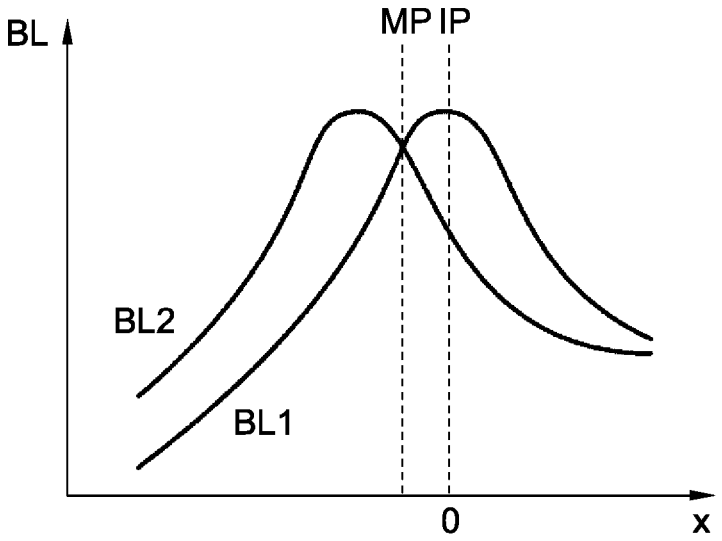
FIG. 3 shows exemplary graphs of the driving force factors of the first and the second coil of the transducer shown in FIG. 1 and FIG. 4 a more detailed embodiment of a transducer system.

Finally, FIG. 3 shows a graph of a first driving force factor BL1 of the first voice coil 7 and a graph of a second driving force factor BL2 of the second voice coil 8. The driving force factors BL7 and BL8 may be measured as it is known in prior art. In particular, FIG. 3 also shows the magnetic zero position MP of the membrane 3 and its desired idle position IP, which differs from the magnetic zero position MP in this example.

A method for calculating the excursion x of membrane 3 is now as follows:

In a first step a), a velocity v of the membrane 3 is calculated based on an input voltage $U_{in}$ and an input current $I_{in}$ to the coils 7, 8 of the transducer 1 and based on an idle driving force factor BL1(0), BL2(0) of the transducer 1 in an idle position IP (where x=0 or assumed to be 0) of the membrane 3.

The velocity v of the membrane 3 may be calculated by the formula $$v(t)=(U_{in}(t)-Z_C\cdot I_{in}(t))/BL(0)$$

wherein $Z_C$ is the coil resistance.

Generally, the velocity v of the membrane 3 can be calculated by use of the electromotive force $U_{emf1}$ of the first coil 7 or the electromotive force $U_{emf2}$ of the second coil 8 or the sum of the electromotive force $U_{emf1}$ of the first coil 7 and the electromotive force $U_{emf2}$ of the second coil 8.

In a first example the electromotive force $U_{emf1}$ of the first coil 7 is used as a basis for the calculation. The electromotive force $U_{emf1}$ is calculated as follows:

$$U_{emf1}=U_{in1}(t)-Z_{C1}\cdot I_{in}(t)$$

Accordingly, the velocity is $$v(t)=(U_{in1}(t)-Z_{C1}I_{in}(t))/BL1(0)$$

In a second step b), the position x of the membrane 3 is calculated by integrating said velocity v. Either by $$x(t)=\int v(t)\cdot dt$$

or by $$x(t)=x(t-1)+v(t)\cdot\Delta t$$

In a next step c), the velocity v of the membrane 3 is calculated based on the input voltage $U_{in}$ and the input current $I_{in}$ to the coil 7 of the transducer 1 and based on a driving force factor BL(x) of the transducer 1 at the position x of the membrane 3 calculated in step b). In our example the velocity v is calculated by the formula $$v(t)=(U_{in1}(t)-Z_{C1}\cdot I_{in}(t))/BL1(x(t))$$

Steps b) and c) are recursively repeated until a desired accuracy is obtained.

In the above example, the velocity v, the input voltage $U_{in}$, the input current $I_{in}$, the idle driving force factor BL(0), the driving force factor BL(x) and the position x are related to the same point in time t. That means, that a sample of the input voltage $U_{in}$, the input current $I_{in}$ is taken once, and the position x is calculated in several iterations.

However, the velocity v, the input voltage $U_{in}$, the input current $I_{in}$, the idle driving force factor BL(0), the driving force factor BL(x) and the position x may also be related to different points in time t. If so, steps c) and d) are altered. In step c), the velocity v(t+1) of the membrane 3 based on the input voltage $U_{in}(t+1)$ and the input current $I_{in}(t+1)$ to the coil 7 of the transducer 1 and based on a driving force factor BL(x(t)) of the transducer 1 at the position x(t) of the membrane 3 is calculated. In our example using the first coil 7 this means $$v(t+1)=(U_{in}(t+1)-Z_C\cdot I_{in}(t+1))/BL(x(t))$$

Accordingly, steps b) and c) are recursively repeated wherein t gets t+1. In this way, the calculation of the position x is an ongoing process, whose accuracy basically depends on how fast the calculation is in relation to the velocity v of the membrane 3. In simple words this means that the calculation of the position x is the more accurate the lower the frequency of the signal driving the membrane 3 is.

As an alternative to the methods presented hereinbefore, the calculation of the velocity v of the membrane 3 may be done with the idle driving force factor BL(0) in the idle position IP of the membrane 3 in a first step, which is corrected then by a factor showing the relation between BL(0) and BL(x). Accordingly, the velocity v of the membrane 3 can be calculated by the formula $$v(t+1)=v_(t+1)\cdot BL(0)/BL(x(t)) \text{ in step } c) \text{ wherein}$$

$$v_(t+1)=(U_{in}(t+1)-Z_C\cdot I_{in}(t+1))/BL(0)$$

Here, v~ is a rough approximation of the velocity of the membrane 3 calculated with the use of the idle driving force factor BL(0) in the idle position IP of the membrane 3. This velocity then is corrected by use of the factor BL(0)/BL(x(t)).

In real applications, the idle position IP of the membrane 3 (x=0) often does not coincide with the point where the electromotive force $U_{emf1}$ of the first coil 7 equals the electromotive force $U_{emf2}$ of the second coil 8. This leads to a deviation of the calculated position x of the membrane 3 from the real position of the membrane 3.

In other words, the conjunction area between the first coil 7 and the second coil 8 is not in the same plane as the top plate 11. This deviation may be caused by a specific design and/or tolerances during manufacturing.

To avoid or reduce this deviation, a control voltage is applied to at least one of the voice coils 7, 8 and altered until the electromotive force $U_{emf1}$ of the first coil 7 and the electromotive force $U_{emf2}$ of the second coil 8 substantially reach a predetermined relation and until the coil arrangement reaches a desired idle position IP. The electromotive force $U_{emf1}$ of the first coil 7 and the electromotive force $U_{emf2}$ of the second coil 8 can be calculated by the formulas $$U_{emf1}=U_{in1}(t)-Z_{C1}\cdot I_{in}(t)$$

$$U_{emf2}=U_{in2}(t)-Z_{C2}\cdot I_{in}(t)$$

Generally, said relation can be a particular ratio or a difference between said values. Particularly, the desired idle position IP can be the magnetic zero position MP, in which the idle position IP of the membrane (x=0) coincides with the point where the electromotive force $U_{emf1}$ of the first coil equals the electromotive force $U_{emf2}$ of the second coil. In this particular point a ratio between said values is substantially 1, respectively a difference between said values is substantially 0.

The application of the control voltage may also be based on a parameter derived from the electromotive force $U_{emf1}$, $U_{emf2}$. Beneficially, said parameter is an absolute value of the electromotive force $U_{emf1}$, $U_{emf2}$, a square value of the electromotive force $U_{emf1}$, $U_{emf2}$ or a root mean square value of the electromotive force $U_{emf1}$, $U_{emf2}$.

Accordingly, the control voltage may be applied to at least one of the voice coils 7, 8 and altered until a (root mean) square value of the electromotive force $U_{emf1}$ of the first coil 7 and a (root mean) square value of the electromotive force $U_{emf2}$ of the second coil 8 substantially reach a predetermined relation. Alternatively, the control voltage may be applied to at least one of the voice coils 7, 8 and altered until an absolute value of the electromotive force $U_{emf1}$ of the first coil 7 and an absolute value of the electromotive force $U_{emf2}$ of the second coil 8 reach a predetermined relation. It should be noted that the offset compensation method may also be based on a relation of other parameters derived from the electromotive forces $U_{emf1}$, $U_{emf2}$.

Particularly, the electromotive forces $U_{emf1}$ and $U_{emf2}$/parameters derived thereof are determined in the whole audio band in a first step, the energy of the electromotive forces $U_{emf1}$ and $U_{emf2}$ respectively a parameter thereof is determined in a second step, and the result of the second step is low pass filtered by a first filter, which may be part of the offset calculation module 13. Finally, the signals obtained in the third step are used for application of the control voltage $U_{CTRL}$. For example, the cut off frequency of said low pass filter is 50 Hz in case of a micro speaker and 10 Hz case of other speakers. Preferably, the cut off frequency is 20 Hz in case of a micro speaker and 5 Hz case of other speakers.

Thus, a frequency of an alternating component of the control voltage $U_{CTRL}$ is low in comparison to the frequencies of the sound output by the transducer 1. Generally, the control voltage $U_{CTRL}$ may comprise a constant component and an alternating component. In special cases, the control voltage $U_{CTRL}$ may also be a pure DC-voltage. The control voltage is applied to at least one of the voice coils 7, 8 and altered until the electromotive force $U_{emf1}$ of the first coil 7/a parameter derived thereof substantially equals the electromotive force $U_{emf2}$ of the second coil 8/said parameter derived thereof below the above frequencies.

The above-mentioned filter structures illustrate the inertial behavior of the control loop. A realization of the control loop may be based on state of the art control loop theory based on PID controller (proportional-integral-derivative controller) of arbitrary order.

In the examples presented hereinbefore, the electromotive force $U_{emf1}$ of the first coil 7 was used to determine an excursion x of the membrane 3. However, in the same way the electromotive force $U_{emf2}$ of the second coil 8 or the sum of the electromotive force $U_{emf1}$ of the first coil 7 and the electromotive force $U_{emf2}$ of the second coil 8 may be used for this reason. If so, $$v(t)=(U_{in2}(t)-Z_{C2}\cdot I_{in}(t))/BL2$$

or $$v(t)=(U_{in1}(t)+U_{in2}(t)-(Z_{C1}+Z_{C2})\cdot I_{in}(t))/BL12$$

may be used for the calculation of the velocity v of the membrane 3, wherein BL12 is the driving force factor of the complete coil arrangement 6.

The calculations presented hereinbefore as well as the application of a control voltage to the coil arrangement 6 generally may be done by the offset compensation circuit 12. The offset compensation circuit 12 may be a standalone device or may be integrated into another device.

The presented method for calculating the position x of the membrane 3 can be used to compensate non-linearities of the transducer 1. For example, the non-linear graph of the driving force factor BL (see FIG. 3) leads to a non-linear conversion of the electric signals fed to the coil arrangement 6 into a movement of the membrane 3. Knowing the position x of the membrane 3, this non-linearity can be compensated by altering the electric signals.

Figure 4:
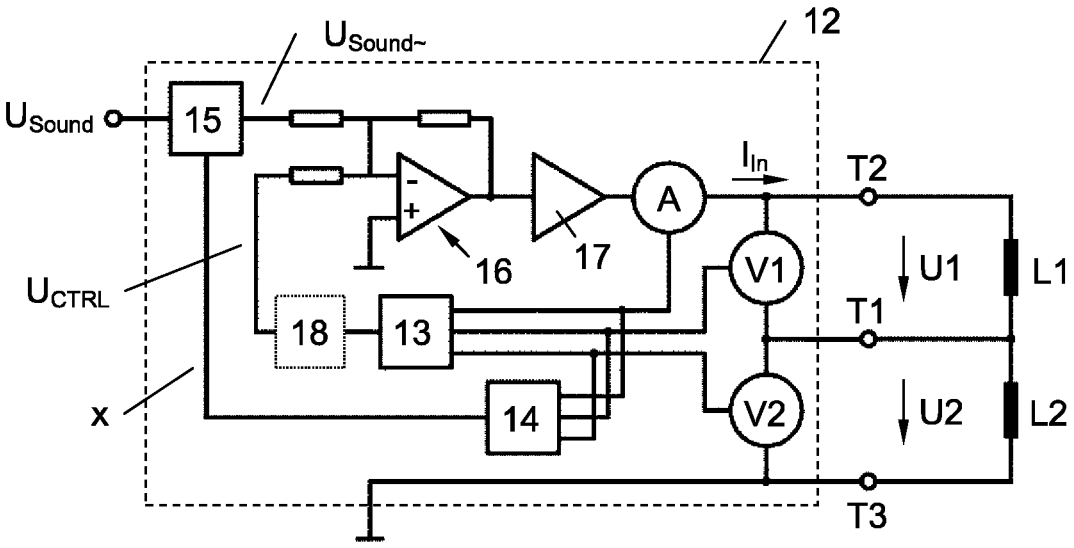

FIG. 4 now shows a more concrete embodiment of a transducer system, particularly of the electronic offset compensation circuit 12 connected to the coil arrangement 6, which is shown by the inductances L1 and L2 in FIG. 4. The electronic offset compensation circuit 12, comprises an offset calculation module 13, a position calculation module 14, a sound signal changing module 15, a mixer 16 and a power amplifier 17.

The offset calculation module 13 is connected to a current measuring device A, and a first voltage measuring device V1 and a second voltage measuring device V2. As explained above, the electromotive force $U_{emf1}$ of the first coil 7 and the electromotive force $U_{emf2}$ of the second coil 8 can be calculated based on the input current $I_{in}(t)$ to the first coil 7 and the second coil 8, which is measured with the current measuring device A, the input voltage $U_{in1}(t)$ to the first coil 7, which is measured with the first voltage measuring device V1, the input voltage $U_{in2}(t)$ to the second coil 8, which is measured with the second voltage measuring device V2, and the coil resistance $Z_{C1}$ of the first coil 7 and the coil resistance $Z_{C2}$ of the second coil 8, which are considered to be known from a separate measurement. Based on this information, the offset calculation module 13 calculates a control voltage $U_{CTRL}$, which is applied to the coils 7 and 8.

The offset calculation module 13 especially may comprise a delta sigma modulator which does the offset compensation according to a delta sigma modulation. In this case, a deviation from the target relation between the electromotive force $U_{emf1}$ of the first coil 7 and the electromotive force $U_{emf2}$ of the second coil 8 is summed with opposite sign and applied to the coil arrangement 6 thus compensating the above deviation and thus heading for the desired idle position IP. A delta sigma modulator can also be considered as an integral controller, and other integration controllers may be used in the offset calculation module 13 as well. The application of the control voltage $U_{CTRL}$ by the offset calculation module 13 may also be based on a parameter derived from the electromotive force $U_{emf1}$, $U_{emf2}$ as disclosed hereinbefore.

In addition to an optional first filter in the offset calculation module 13 a second filter 18 may be arranged downstream of the offset calculation module 13. The first filter avoids that the offset calculation module 13 interferes with the sound output of the transducer 1. The second filter 18 reduces or avoids instability in the control loop.

As explained above, also the position x can be calculated by use of the input current $I_{in}(t)$ to the first coil 7 and the second coil 8, the input voltage $U_{in1}(t)$ to the first coil 7, the input voltage $U_{in2}(t)$ to the second coil 8 as well as the driving force factor BL(x) of the transducer 1. This job is performed by the position calculation module 14, which calculates the position x of the membrane 3 and in this example outputs it to the sound signal changing module 15. The sound signal changing module 15 compensates non-linearity in the driving force factor BL(x) (see FIG. 3) based on the membrane position x. Concretely, the sound signal changing module 15 alters the input sound signal $U_{Sound}$ based on the membrane position x and the driving force factor BL(x) and outputs an altered sound signal $U_{Sound\sim}$ so that sound emanating from the transducer 1 fits to the sound signal $U_{Sound}$ as best as possible, and distortions are kept low. Alternatively or in addition, the level of the sound signal $U_{Sound}$ may be limited, or it may be cut off by the sound signal changing module 15 at high membrane excursions x so as to avoid damages of transducer 1. Of course, the membrane position x may also be used for other controls and output to external electronic circuits.

It should be noted at this point that shifting the idle position IP of the membrane 3 does not necessarily involve the position calculation as presented above. Shifting the idle position IP of the membrane 3 may simply be based on altering the desired relation between the electromotive force $U_{emf1}$ of the first coil 7 and the electromotive force $U_{emf2}$ of the second coil 8 or based on altering a desired relation of parameters derived from the electromotive forces $U_{emf1}$, $U_{emf2}$.

It should also be noted that in the example shown in FIG. 4 both the position calculation module 14 and the sound signal changing module 15 comprise information about the driving force factor BL(x). In the position calculation module 14 this information is used to calculate the membrane position x, whereas in the sound signal changing module 15 the sound signal $U_{Sound}$ is altered by use of the driving force factor BL(x). Of course, both functions can be integrated into a single module, and of course the sound signal changing module 15 can also comprise other information about the transducer 1 up to a complete model so as to avoid distortions when converting the sound signal $U_{Sound}$ into sound.

In the example shown in FIG. 4, the control voltage $U_{CTRL}$ is mixed with the altered sound signal $U_{Sound\sim}$ by the mixer 16. Finally, the mixed signal is amplified by the power amplifier 17 and applied to the transducer 1. Because of the mixer 16, the altered sound signal $U_{Sound\sim}$ is applied during application of a control voltage $U_{CTRL}$.

It should be noted that the electronic offset compensation circuit 12 just shows the general function by use of functional blocks for illustrating purposes. Putting the disclosed functions into practice may need amendments of the electronic offset compensation circuit 12 and more detailed electronics. Functional blocks do not necessarily coincide with physic blocks in a real offset compensation circuit 12. A real physic block may incorporate more than one of the functions shown in FIG. 4. Moreover, dedicated functions of the functions shown in FIG. 4 may also be omitted in a real offset compensation circuit 12, and a real offset compensation circuit 12 may also perform more than the discloses functions.

For example, the position calculating module 14 and the sound signal changing module 15 may be omitted. In this case, the sound signal $U_{Sound}$ is applied to the transducer unchanged. In a further example, just the sound signal changing module 15 is omitted. In this case the position calculating module 14 may output the position x to an external sound signal changing circuit. One skilled in the art will also easily realize that the power amplification and the mixing can be done with just one amplifier.

In this example, both the control voltage $U_{CTRL}$ and the altered sound signal $U_{Sound\sim}$ are applied to both the first coil 7 and the second coil 8, i.e. to an outer tap of the coil arrangement 6. Nevertheless, this is an advantageous solution, it is not the only one. In an alternate embodiment, the control voltage $U_{CTRL}$ is applied just to the first coil 7 and the (altered) sound signal $U_{Sound\sim}$ is applied to just the second coil 8. In this case, a mixer 16 can be omitted as the control voltage $U_{CTRL}$ and the altered sound signal $U_{Sound\sim}$ are superimposed by the movement of the membrane 3.

In summary, the electronic offset compensation circuit 12, depending on which functions it comprises, provides a proper solution for feeding a sound signal $U_{Sound}$ to a transducer 1 while keeping distortions low and while avoiding damage of the transducer 1. In combination with the transducer 1 an advantageous transducer system is presented which allows for easy operation. A user just needs to feed a signal to be converted into sound to the transducer system and does not need to care about distortions and/or avoiding damage of the transducer 1. Preferably, the electronic offset compensation circuit 12 and the transducer 1 are embodied as a single device or module. For example, the electronic offset compensation circuit 12 can be arranged in the housing 2 of the transducer 1.

Generally, the transducer 1 respectively the membrane 3 may have any shape in a top view, in particular a rectangular, circular or ovular shape. Furthermore, the coils 7 and 8 may have the same height or different heights, the same diameter or different diameters as well as the same number of winding or different numbers of windings.

It should be noted that although avoiding an offset of the membrane 3 was just disclosed in the advantageous context with the calculation of a membrane position x, avoiding an offset of the membrane 3 is not limited to this particular application. In contrast, it may also be used for simply shifting the membrane 3 into that position, which is intended as the idle position IP by design thereby compensating tolerances and improving the performance of the transducer 1 in general. Accordingly, distortions of the audio output of the transducer 1 can be reduced and/or symmetry may be improved thereby allowing for the same membrane stroke in forward and backward direction. The membrane 3 may also be shifted to an altered desired idle position IP so as to alter the sound characteristics of the transducer 1.

It should be noted that the invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention. The scope of the present invention is defined by the appended claims, including known equivalents and unforeseeable equivalents at the time of filing of this application. Although numerous embodiments of this invention have been described above with a certain degree of particularity, those skilled in the art could make numerous alterations to the disclosed embodiments without departing from the spirit or scope of this disclosure.

Particularly, it should be noted that the position calculation method and the position calculation module 14 for calculating a membrane position x as well as a transducer system comprising such a position calculation module 14 (i.e. the features of any one of claims 10-17, 19 and 20) can form the basis of an independent invention without the limitations of claims 1 and 18.

The very same counts for the application of a sound signal just to an outer tap of the serially connected voice coils 7, 8 (i.e. the features of claim 9) as well as a transducer system with those features, which can form the basis of an independent invention without the limitations of claims 1 and 18.

LIST OF REFERENCES

1 electrodynamic acoustic transducer
2 housing
3 membrane
4 bending section
5 stiffened center section
6 coil arrangement
7 first coil
8 second coil
9 magnet
10 pot plate
11 top plate
12 electronic offset compensation circuit
13 offset calculation module (with optional first filter)
14 position calculation module
15 sound signal changing module
16 mixer
17 power amplifier
18 second filter
A current measuring device
B magnetic field
BL driving force factor
BL1 driving force factor of the first coil
BL2 driving force factor of the second coil
$I_{in}$ input current
L1 inductance of the first coil
L2 inductance of the second coil
MP magnetic zero position
IP desired idle position
T1 . . . T3 connection terminals
U1 voltage at the first coil
U2 voltage at the second coil $U_{CTRL}$ control voltage
$U_{In}$ input voltage
$U_{Sound}$ sound signal
$U_{Sound\sim}$ altered sound signal
v membrane velocity
V1 first voltage measuring device
V2 second voltage measuring device
x membrane excursion

What is claimed is:

1. A method for avoiding an offset of a membrane of an electrodynamic acoustic transducer, wherein the electrodynamic acoustic transducer comprises a voice coil arrangement attached to the membrane, the voice coil arrangement having a first voice coil and a second voice coil, the method comprising:

applying a control voltage $U_{CTRL}$ to at least one of the first voice coil and the second voice coil; and altering the control voltage $U_{CTRL}$ until a calculated value of the electromotive force $U_{emf1}$ of the first voice coil or a parameter derived thereof and a calculated value of the electromotive force $U_{emf2}$ of the second voice coil or said parameter derived thereof substantially reach a predetermined numeric relation.

2. The method as claimed in claim 1, wherein the electromotive force $U_{emf1}$ of the first voice coil and the electromotive force $U_{emf2}$ of the second voice coil are calculated by the formulas:

$$U_{emf1}=U_{in1}(t)-Z_{C1}\cdot I_{in}(t)$$

$$U_{emf2}=U_{in2}(t)-Z_{C2}\cdot I_{in}(t)$$

wherein $Z_{C1}$ is the coil resistance of the first voice coil, $U_{in1}(t)$ is the input voltage to the first voice coil at the time t and $I_{in}(t)$ is the input current to the first voice coil at the time t and wherein $Z_{C2}$ is the coil resistance of the second voice coil, $U_{in2}(t)$ is the input voltage to the second voice coil at the time t and $I_{in}(t)$ is the input current to the second voice coil at the time t.

3. The method as claimed in claim 2, wherein a parameter derived from the electromotive force $U_{emf1}$, $U_{emf2}$ is an absolute value of the electromotive force $U_{emf1}$, $U_{emf2}$, a square value of the electromotive force $U_{emf1}$, $U_{emf2}$ or a root mean square value of the electromotive force $U_{emf1}$, $U_{emf2}$.

4. The method as claimed in claim 3, wherein the control voltage $U_{CTRL}$ is applied to at least one of the first and second voice coils and altered until the low pass filtered electromotive force $U_{emf1}$ of the first voice coil or a parameter derived thereof and the low pass filtered electromotive force $U_{emf2}$ of the second voice coil or said parameter derived thereof substantially reach a predetermined numeric relation.

5. The method as claimed in claim 4, wherein a delta sigma modulation is used for applying a control voltage $U_{CTRL}$ to at least one of the first and second voice coils.

6. The method as claimed in claim 5, wherein a signal output of the delta sigma modulator is filtered before it is applied to at least one of the first and second voice coils.

7. The method as claimed in claim 4, wherein a control voltage $U_{CTRL}$ is applied to both the first voice coil and the second voice coil.

8. The method as claimed in claim 7, wherein a sound signal is applied to the first voice coil and/or the second voice coil during application of a control voltage $U_{CTRL}$.

9. The method as claimed in claim 8, wherein the voice coil arrangement further comprises the first voice coil and the second voice coil being serially connected, and wherein the sound signal is only applied to an outer tap of one of the first or second voice coils.

10. The method as claimed in claim 1, comprising the steps of:

a) calculating a velocity of the membrane based on an input voltage $U_{in}$ and an input current $I_{in}$ to at least one of the first or second voice coils of the transducer and based on an idle driving force factor of the transducer when the membrane is in an idle position;

b) calculating a position of the membrane by integrating said velocity;

c) calculating the velocity of the membrane based on the input voltage $U_{in}$ and the input current $I_{in}$ to the at least one of the first or second voice coils of the transducer and based on a driving force factor of the transducer at the position of the membrane calculated in step b); and d) recursively repeating steps b) and c).

11. The method as claimed in claim 10, characterized in that the velocity, the input voltage $U_{in}$, the input current $I_{in}$, the idle driving force factor, the driving force factor and the position are related to the same point in time.

12. The method as claimed in claim 10, characterized in that the velocity, the input voltage $U_{in}$, the input current $I_{in}$, the idle driving force factor, the driving force factor and the position are related to different points in time.

13. The method as claimed in claim 12, comprising the steps of:

a) calculating a velocity v(t) of the membrane based on an input voltage $U_{in}(t)$ and an input current $I_{in}(t)$ to at least one of the first or second voice coils of the transducer and based on an idle driving force factor of the transducer when the membrane is in an idle position;

b) calculating a position x(t) of the membrane by integrating said velocity v(t);

c) calculating the velocity v(t+1) of the membrane based on the input voltage $U_{in}(t+1)$ and the input current $I_{in}(t+1)$ to the at least one of the first or second voice coils of the transducer and based on a driving force factor BL(x(t) of the transducer at the position x(t) of the membrane calculated in step b); and d) recursively repeating steps b) and c) wherein t gets t+1.

14. The method as claimed in claim 10, wherein the position x(t) of the membrane is calculated by the formula:

$$x(t)=x(t-1)+v(t)\cdot\Delta t.$$

15. The method as claimed in claim 14, wherein the velocity v(t) of the membrane is calculated by the formula:

$$v(t)=(U_{in}(t)-Z_C\cdot I_{in}(t))/BL(0) \text{ in step } a) \text{ or by}$$

$$v(t+1)=(U_{in}(t+1)-Z_C\cdot I_{in}(t+1))/BL(x(t)) \text{ in step } c)$$

16. The method as claimed in claim 14, wherein the velocity v−(t) of the membrane is calculated by the formula:

$$v(t+1)=v_(t+1)\cdot BL(0)/BL(x(t)) \text{ in step } c) \text{ wherein}$$

$$v_(t+1)=(U_{in}(t+1)-Z_C\cdot I_{in}(t+1))/BL(0)$$

17. The method as claimed in claim 14, wherein the velocity v−(t) of the membrane is calculated by use of the electromotive force $U_{emf1}$ of the first voice coil, or the electromotive force $U_{emf2}$ of the second voice coil, or the sum of the electromotive force $U_{emf1}$ of the first voice coil and the electromotive force $U_{emf2}$ of the second voice coil.

18. An electronic offset compensation circuit configured to be connected to a voice coil arrangement of an electrodynamic acoustic transducer, wherein the electrodynamic acoustic transducer comprises a membrane attached to the voice coil arrangement and a magnet system configured to generate a magnetic field transverse to a longitudinal direction of a wound wire of the voice coil arrangement, wherein the voice coil arrangement comprises a first voice coil and a second voice coil, and wherein the electronic offset compensation circuit is further configured to apply a control voltage $U_{CTRL}$ to at least one of the first and second voice coils and to alter said control voltage $U_{CTRL}$ until a calculated value of the electromotive force $U_{emf1}$ of the first voice coil or a parameter derived thereof and a calculated value of the electromotive force $U_{emf2}$ of the second voice coil or a parameter derived thereof substantially reach a predetermined numeric relation.

19. The electronic offset compensation circuit as claimed in claim 18, wherein the electronic offset compensation circuit is further configured to:

a) calculate a velocity of the membrane based on an input voltage $U_{in}$ and an input current $I_{in}$ to at least one of the first and second voice coils and based on an idle driving force factor of the transducer when the membrane is in an idle position;

b) calculate a position of the membrane by integrating said velocity;

c) calculate the velocity of the membrane based on the input voltage $U_{in}$ and the input current $I_{in}$ to the coil of the transducer and based on a driving force factor of the transducer at the position of the membrane calculated in step b); and d) recursively repeat steps b) and c).

20. An electrodynamic acoustic transducer comprising:

an electronic offset compensation circuit;

a voice coil arrangement electrically connected to the offset compensation circuit, wherein the voice coil arrangement comprises a first voice coil and a second voice coil;

a membrane attached to the voice coil arrangement; and a magnet system configured to generate a magnetic field transverse to a longitudinal direction of a wound wire of the voice coil arrangement, wherein the electronic offset compensation circuit is configured to apply a control voltage $U_{CTRL}$ to at least one of the first and second voice coils and to alter said control voltage $U_{CTRL}$ until a calculated value of the electromotive force $U_{emf1}$ of the first voice coil or a parameter derived thereof and a calculated value of the electromotive force $U_{emf2}$ of the second voice coil or a parameter derived thereof substantially reach a predetermined numeric relation.

21. The electrodynamic acoustic transducer of claim 20, wherein the electronic offset compensation circuit is further configured to:

a) calculate a velocity of the membrane based on an input voltage $U_{in}$ and an input current $I_{in}$ to at least one of the first and second voice coils and based on an idle driving force factor of the transducer when the membrane is in an idle position;

b) calculate a position of the membrane by integrating said velocity;

c) calculate the velocity of the membrane based on the input voltage $U_{in}$ and the input current $I_{in}$ to the coil of the transducer and based on a driving force factor of the transducer at the position of the membrane calculated in step b); and d) recursively repeat steps b) and c).

* * * * *